US007650828B2

(12) United States Patent
Rau et al.

(10) Patent No.: US 7,650,828 B2
(45) Date of Patent: Jan. 26, 2010

(54) PISTON AND A FLUID OPERATED SETTING DEVICE CONNECTED THEREWITH

(75) Inventors: Michael Rau, Esslingen (DE); Wolfgang Rammler, Stuttgart (DE)

(73) Assignee: Festo AG & Co. KG, Esslingen (DE)

( * ) Notice: Subject to any disclaimer, the term of this patent is extended or adjusted under 35 U.S.C. 154(b) by 290 days.

(21) Appl. No.: 11/791,198

(22) PCT Filed: Feb. 23, 2006

(86) PCT No.: PCT/EP2006/001637

§ 371 (c)(1),
(2), (4) Date: May 21, 2007

(87) PCT Pub. No.: WO2006/105828

PCT Pub. Date: Oct. 12, 2006

(65) Prior Publication Data

US 2007/0279045 A1 Dec. 6, 2007

(30) Foreign Application Priority Data

Apr. 7, 2005 (DE) ..... 20 2005 005 508 U

(51) Int. Cl.
*F01B 31/12* (2006.01)

(52) U.S. Cl. ..... 92/5 R

(58) Field of Classification Search ..... 92/5 R; 91/1

See application file for complete search history.

(56) References Cited

U.S. PATENT DOCUMENTS

| | | | | |
|---|---|---|---|---|
| 4,723,503 | A | 2/1988 | Yuda | |
| 5,813,313 | A * | 9/1998 | Stoll et al. | 92/5 R |

FOREIGN PATENT DOCUMENTS

| | | | |
|---|---|---|---|
| DE | 1185276 | B | 12/1962 |
| DE | 3015258 | A1 | 10/1981 |
| DE | 3404095 | A1 | 8/1985 |
| DE | 3687690 | T2 | 10/1986 |
| EP | 0221676 | | 5/1987 |
| EP | 0264682 | | 4/1988 |
| EP | 1058037 | A1 | 12/2000 |
| JP | 04 236804 | | 8/1992 |
| JP | 08270614 | | 10/1996 |
| WO | WO 03/093682 | | 11/2003 |

* cited by examiner

*Primary Examiner*—Michael Leslie
(74) *Attorney, Agent, or Firm*—Hoffmann & Baron, LLP

(57) ABSTRACT

A piston for a setting device operated by fluid power is suggested. The piston includes a support body having an annular recess with an axis coinciding with the longitudinal axis of the piston, such recess having at least one annular permanent magnet arrangement therein. The permanent magnet arrangement is segmented in its peripheral direction and consists of at least two accurate magnet segments. The annular recess is in the form of an annular groove with a radially outwardly directed groove opening into which the magnet segments are inserted radially from the outside with the formation of an annular configuration.

22 Claims, 3 Drawing Sheets

PISTON AND A FLUID OPERATED SETTING DEVICE CONNECTED THEREWITH

BACKGROUND OF THE INVENTION

The invention relates to a piston for a fluid operated setting device, in particular a linear drive or a shock absorber, comprising a support body, which possesses an annular recess whose axis coincides with the longitudinal axis of the piston, in which recess at least one annular permanent magnet arrangement is disposed. Furthermore the invention relates to a fluid operated setting device fitted with such a permanent magnet arrangement.

Subject matter of the type initially mentioned type is described for example in the German patent publication DE 3404095 C2. In this case it is a question of a linear drive in the form of a power cylinder driven by fluid power comprising a piston, secured to a piston rod, for transmission of the drive force. For detecting the position of the piston without contacting it physically the piston bears a permanent magnet arrangement in the form of an annular permanent magnet, which can cooperate with position detecting means carried on the housing. The permanent magnet is seated in an annular recess defined at the joint face between two axially connected piston parts. The assembly of the piston takes place on fitting to the piston rod, the annular permanent magnet also being placed between the two piston parts. In the case of such a design there is particularly the difficulty, in view of the complexity, due to the necessary integration of the permanent magnet arrangement and, of the piston structure and the involved assembly in connection with it.

The European patent publication EP 1058037 has therefore already made a proposal to produce the annular permanent magnet of plastic material filled with permanently magnetic components by injection molding including injection molding directly into an annular groove, accessible from the outside, in the support body of the piston. This is however dependent on a technically highly complex operation, which is only realistic with a substantial production volume.

The German patent publication 1 185 276 discloses a specially customized structure of a stator of an electric motor. This stator comprises a plurality of magnet segments, which are partially elastic and inserted axially into a cylindrical iron casing.

SUMMARY OF THE INVENTION

One object of the present invention is to provide a piston and a fluid operated setting device, fitted therewith, still with the detection facility but providing for simplifications as regards production and assembly.

In the case of a piston of the type initially mentioned this aim is to be achieved by the permanent magnet arrangement's being segmented in its peripheral direction and consisting of at least two arcuate magnet segments, the annular recess being in the form of an annular groove with a radially outwardly directed groove opening, into which the magnet segments are inserted radially from the outside with the formation of an annular configuration.

Furthermore the aim is achieved with a fluid actuated setting device, which has a housing with position detecting means, such housing defining a receiving chamber, in which a piston of the type initially mentioned is arranged in a sliding manner and which is kinematically coupled with a force output part accessible outside the housing.

The piston structure in accordance with the invention renders possible a simple production of the annular magnet design without the obligatory requirement of having a division of the piston at the recess receiving the permanent magnet arrangement. The annular permanent magnet arrangement is composed of several arcuate magnet segments, which may be inserted, during the production of the piston, radially from the outside into the annular recess in the form of an annular groove in order then to define an admittedly segmented, but nevertheless annular permanent magnet arrangement. Such a piston may be put together relatively simply independently from fitting to a force output part, something which reduces stockholding costs the improves availability. Furthermore, for a specific reduction in costs it is possible to even have a single-part support body, because the assembly of the permanent magnet arrangement does not entail any division of the support body.

The German patent publication DE 3687690 T2 has the admittedly previously disclosed basic notion in connection with a rotary locking magnet to utilize a series of permanent magnet segments magnetized in the thickness direction instead of a circular magnet. However in this case it is a question of a different application in a non-related art. In this case the annular magnet, which if required is segmented, serves to form a magnetic field holding a magnet armature (which provides a locking function) in the locked position.

The European patent publication EP 0264682 has the already described principle of locking a permanent magnet radially from the outside in a peripheral well in a piston. The permanent magnet is however in this case in the form of a relatively small piece of magnetic material, which is mounted at a single point in a peripheral recess. The resulting magnetic field consequently only acts in a narrow peripheral area of the piston, something making necessary an additional means for preventing rotation, when detection of the position of the piston is desired.

Further advantageous developments of the invention are defined in the dependent claims.

Preferably the magnet segments are magnetized with the same orientation as each other in order despite the segmentation, to ensure a magnetic field which is as even as possible along the entire annular periphery. Axial magnetization of the magnet segments has turned out to be particularly advantageous.

The number of magnet segments for the formation of the annularly configured permanent magnet arrangement is not in principle restricted. It is convenient in any case to utilize magnet segments exclusively having the same arcuate length and preferably with the same structure. In the case of a particularly preferred design the permanent magnet arrangement is composed of just two magnet segments whose end sections are associated with each other in pairs. Assembly as part of the production of the piston may in this case take place more particularly by insertion into the recess in the form of an annular groove, from diametrally opposite support sides.

It is possible to design the magnet segments so that mutually opposite end sections of the magnet segments, which are adjacent to each other in the peripheral direction, are opposite to each other free of overlap. The magnet segments may in this case may be bluntly engaged with each other. Since however in this case in some case relatively high magnetic repulsion forces may be present at the joints or transitions, such a design should be combined with additional attachment measures in order to carry the individual magnet segments in position on the piston. For instance a form of attachment with a detent or catch action or by bonding would be possible.

It is regarded as being more advantageous to design the individual magnet segments and for their magnetization to be such that in the assembled state magnetic forces act, by which the mutually facing end sections of the respectively succeeding magnet segments are more or less held together by themselves. In the case of such a self-attachment it is possible, if necessary, to do without additional securing means. Accordingly work for manufacture and assembly is particularly simple.

The self-holding effect may be particularly well produced in conjunction with a configuration, in which the preferably axially magnetized magnet segments overlap at their mutually facing end sections in the peripheral direction of the permanent magnet arrangement. In this case a magnetic force is engendered more especially thrusting the magnet segments together athwart the peripheral direction of the permanent magnet arrangement.

The effective area or face of this magnetic holding force may be caused to be particularly great in a relatively simple fashion if the magnet segments at the mutually facing end sections respectively have a spur (which projects respectively in a first radial plane in the peripheral direction of the permanent magnet arrangement in relation to a reference point) and a recess (which recedes in a second radial plane spaced from and parallel to the first radial plane oppositely in relation to the spur) so that in the mounted state with end sections overlapping the spur of the respectively one end section fits into the recess in the respectively other end section and in the peripheral direction of the permanent magnet arrangement there is a relatively large length of overlap.

The permanent magnet arrangement may be exposed in the radial direction to the outside. Alternatively it may however be covered by a piston component. If the piston is provided with a guide ring, which in the installed state in the housing of a setting device produces the sliding contact with the running face of the piston, the permanent magnet arrangement may be coaxially surrounded by such guide ring.

In the following the invention will be explained in detail with reference to the accompanying drawings.

DETAILED DESCRIPTION OF THE PREFERRED EMBODIMENTS

Figure 1:
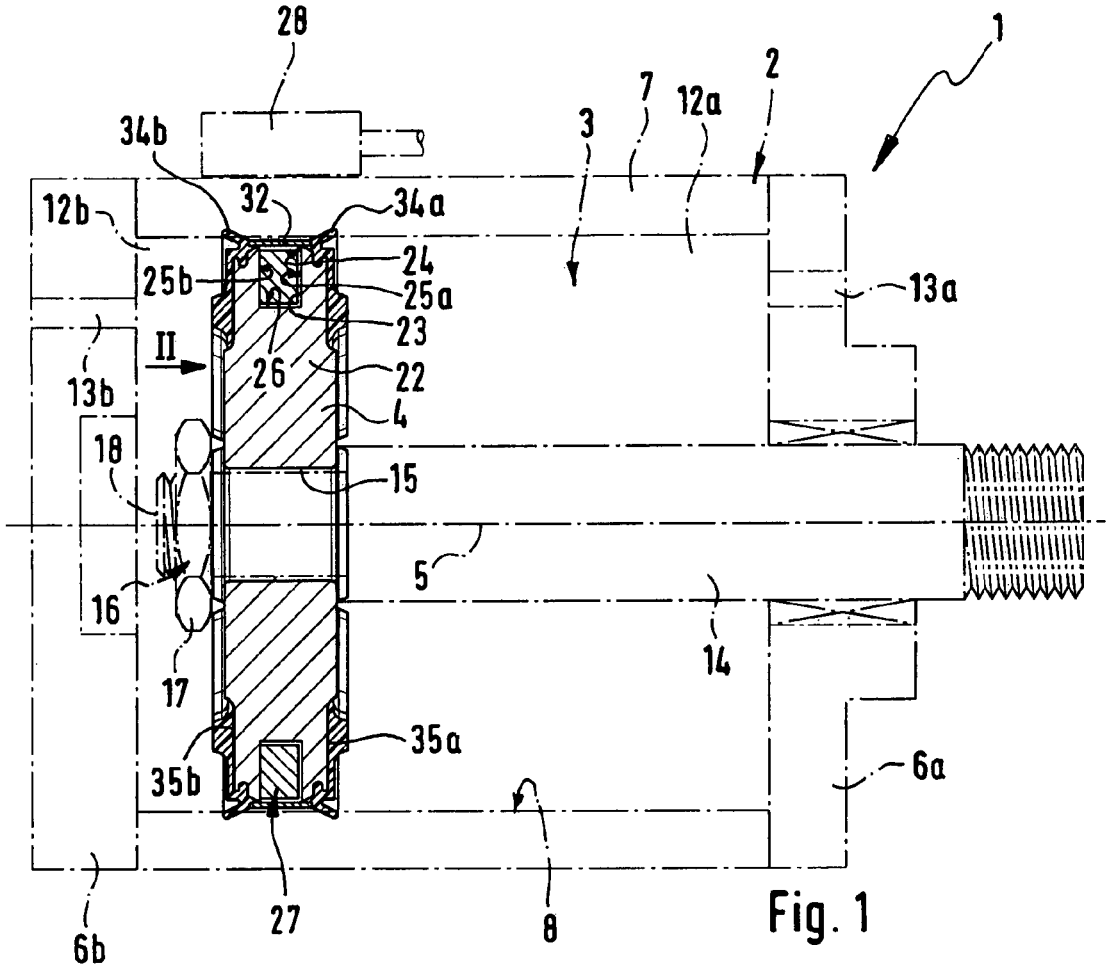
FIG. 1 shows a preferred structure of a piston in accordance with the invention as a component of a fluid power setting or servo device, whose further components are only indicated in chained lines.
Figure 2:
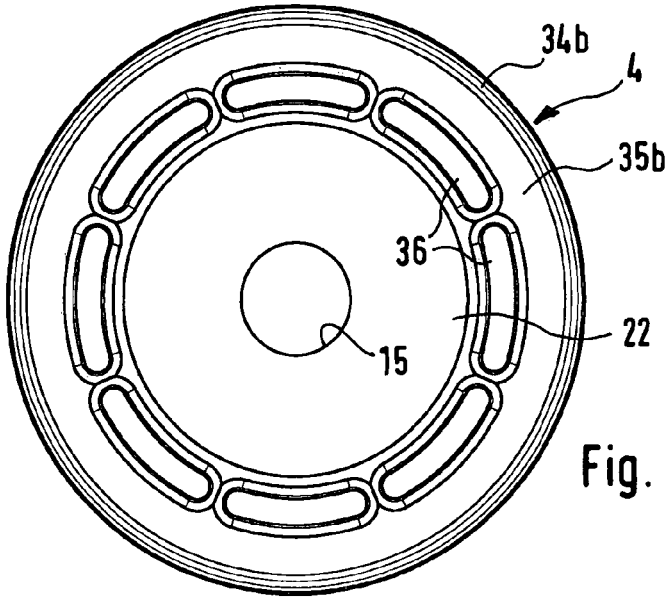
FIG. 2 is an axial view of the piston in accordance with FIG. 1 locking in the direction of the arrow II.
Figure 3:
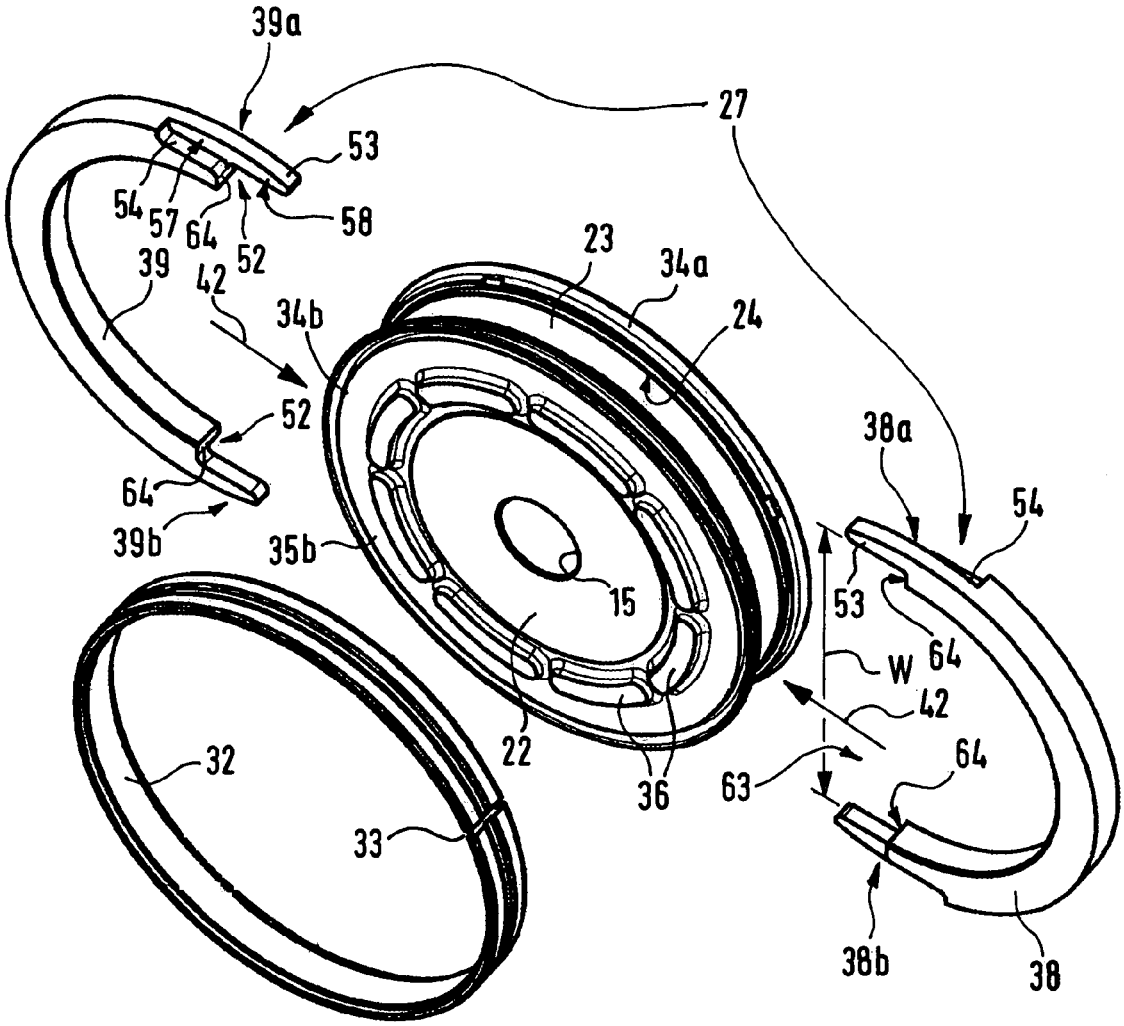
FIG. 3 shows the piston in accordance with FIGS. 1 and 2 in a perspective exploded view.

FIG. 1 generally shows a fluid power setting device 1 in a design as a fluid operated linear drive. The setting device 1 comprises a housing 2, defining a receiving chamber 3 which extends linearly and preferably has a circular cross section, in which a piston 4 having a corresponding circular outline is arranged so that it may reciprocate linearly. The longitudinal axis 5 of the piston extends in the direction of movement of the piston 4 and coincides with the longitudinal axis of the receiving chamber 3.

The receiving chamber 3 is sealed off at each end by a respective terminal wall 6*a* and 6*b* of the housing 2. The peripheral limit of the receiving chamber 3 is due to a single or multi-part tube body 7, extending between the two terminal walls 6*a* and 6*b*, the inner face of the body 7 defining a cylindrical piston engaging face 8, along which the piston 4 slide during its linear motion. The terminal walls 6*a* and 6*b* are best in the form of housing end plates.

The piston 4 divides up the receiving chamber 3 into working spaces 12*a* and 12*b* axially, into which a respective fluid duct 13*a* and 13*b* opens, by way of which controlled fluid action is possible. In accordance with the pressure differential obtaining between the two working spaces 12*a* and 12*b* the piston will be shifted in the one or the other direction or will dwell at one position.

In the case of the fluid employed for operation it is a question preferably of compressed air. Nevertheless the use of another gaseous medium or a hydraulic medium is possible.

The linear movement of the piston 4 may be communicated or transferred to a force output part 14 which is kinematically coupled with the piston 4 and is arranged outside the housing 2. The force output part is in the working example a piston rod sliding through at least one terminal walls 6*a* in a sealed manner and having its section, which lies within the receiving chamber 3 attached to the piston 4. For such attachment the piston 4 preferably has a central through hole 15 so that it can be slipped on the piston rod 14 as far as a step. It is axially locked on the piston rod for example using a screw connection 16, a nut 17 being screwed on a threaded section 18 of the piston rod 14, which projects from the piston rod 14.

The setting device 1 can in principle also be designed in the form of a shock absorber or some other passive component. In this case the piston 4 would be shifted by drive force applied to it without fluid action with displacement of the fluid contained in the receiving chamber 3.

The piston 4 exhibits a preferably integral and more particularly metallic support body 22 in the form of a circular disk, in which the attachment hole 15 is formed.

At its outer periphery the support body 22 is provided with an annular recess which is in the form of an annular groove 23 and has an axis coinciding with the longitudinal axis 5 of the piston and furthermore extends annularly about the support body 22. The slot-like curved groove opening 24, curved to correspond to the peripheral outline of the piston 4, is radially outwardly orientated in relation to the longitudinal axis 5 of the piston and faces the piston's running face 8. Axially on either side the annular groove 23 is delimited by one respective groove flank 25*a* and 25*b* and preferably radially in an inward direction is delimited by a circularly cylindrical groove base face 26. Preferably the cross section of the annular groove 23 is rectangular.

In as far as in the following reference is had to the piston 4 having a "radial plane", this is to be taken to mean a plane extending rectangularly to the piston's longitudinal axis 5. The direction of the longitudinal axis 5 is hence the normal direction of such a radial plane. The two flanks 25*a* and 25*b* of the groove preferably extend in two mutually parallel radial planes.

An annular groove 23 has a permanent magnet arrangement 27 seated coaxially therein. The arrangement extends along the entire periphery of the piston and produces a continuous magnetic field, which pervades the tube body 7.

Outside the receiving chamber 3 position detecting means 28, indicated in FIG. 1 in chained lines, are secured in a manner fixed in relation to the housing. They are best secured to the outer periphery of the tube body 7, for example in one or more longitudinal grooves. A provision may be made for adjustability in the direction of motion of the piston 4.

The position detecting means 28 respond to the magnetic field of the permanent magnet arrangement 27, when the latter is shifted into a predetermined position by corresponding movement of the piston 4, such position being for example radially and inwardly opposite to the position detecting means 28. Accordingly the position of the piston 4 may be detected.

The position detecting means 28 for example comprise at least one so-called reed switch or hall sensor, though they may however be designed in the form of a displacement measurement system.

The permanent magnet arrangement 27 preferably has its outer periphery covered by a component arranged on the piston 4. As a cover there is in the working embodiment a tubular guide ring 32 manufactured of plastic material, which is seated adjacent to axial level of the annular groove 23 coaxially on the outer periphery of the support body 22. In order to provide for simple assembly at one point of its periphery it is interrupted (at interruption 33). Owing to its elasticity it may consequently be splayed out in the course of assembly temporarily.

During operation of the setting device 1 the piston 4 slides with its guide transition 32 running on the face 8.

Axially on either side of the annular groove 23 the support body 22 has a respective piston seal 34*a* and 34*b* whose axis coincides with the longitudinal axis 5 of the piston. Such piston seals are preferably injection molded on the support body 22. The latter furthermore preferably consists of non-magnetizable material such as aluminum or stainless steel in order not to impair propagation of the magnetic field produced by the permanent magnet arrangement 27.

The piston seals 34*a* and 34*b* can be an integral component of two elastomeric components 35*a* and 35*b*, which are molded on the support body 22 and which in addition to the respectively associated piston seal 34*a* and 34*b* may also for example constitute buffer structures 36 at the end face of the piston 4 to deaden impact in the terminal positions.

The permanent magnet arrangement 27 is segmented in its peripheral direction. The said peripheral direction is emphasized in the drawings by a double arrow at 37 and extends around the longitudinal axis of the piston 5.

Owing to the segmentation the permanent magnet arrangement 27 is composed of several arcuate magnet segments 38 and 39, which are inserted with their concave side to the fore through the groove opening 24 as indicated by the arrows 42 in a radially inward direction so that they rest against each other in the peripheral direction and have an annular configuration, which represents the permanent magnet arrangement 27.

The arcuate length of the individual magnet segments 38 and 39 is best so selected that the mutually facing end sections 38*a*, 39*a*, 38*b* 39*b* of the magnet segments 38 and 39 directly following each other in the peripheral direction 37 of the magnet segments (arranged to be directly following each other) are directly adjacent to each other in a transition zone 43 and preferably even touch one another.

In the working embodiment the annular permanent magnet arrangement 27 is composed of just two magnet segments 38 and 39 having the same arcuate length preferably respectively equal to at least 180 degrees. However it would be quite possible to have more than two magnet segments 38 to form the permanently magnetic annular structure in the case of which then the arcuate length would be correspondingly less.

If it is a question of a piston 4 with a circular outline the magnet segments as in the working example the magnet segments 38 will be preferably have the shape of a circular arc too. Their inner radius will be essentially equal to the radius of the floor face 26 of the groove.

The magnet segments 38 and 39 are preferably axially magnetized, i. e. in the direction of the piston's longitudinal axis 5 with the same orientation as each other. Accordingly the north poles, marked "N" in FIG. 4, of all magnet segments 38 and 39 lie on the one axial side of the permanent magnet arrangement 27 and the south poles marked "S" of all magnet segments 38 and 39 in FIG. 4 lie on the other axial side of the permanent magnet arrangement 27. As regards its workings the latter corresponds to an integral annular magnet which is axially magnetized.

As compared with the theoretically possible arrangement with polarities opposite to the polarities of the next magnet segments 38 and 39 the identical orientation has the advantage that a constant magnetic field is produced along the full periphery of the permanent magnet arrangement 27 and accordingly in the transition zone 43 as well. Therefore even in the case of a piston 4 free to rotate a reliable detection of its position is ensured.

The segmentation as described of the permanent magnet arrangement 27 simplifies the production of the piston. Thus the support body 22 may be integral in the zone defining the annular groove 23 and preferably throughout without the mounting of the permanent magnet arrangement 27 being obstructed. The individual magnet segments 38 and 39 can be simply inserted during assembly via the groove opening 24 into the annular groove 23. A subdivision of the support body 22 at the annular groove 23 is accordingly unnecessary.

In the working embodiment the magnet segments 38 and 39 are best so designed that in the respective transition zone 43 they overlap at their end sections 38, 39, 38*b* and 39*b* somewhat in the peripheral direction 37. In this respect the width, as measured in the direction of the piston's longitudinal axis 5, of the magnet segments 38 and 39 is locally reduced in a matching manner at the said end sections so that all in all there is also a constant width of the permanent magnet arrangement 27. The overlapping sections of the magnet segments 38 and 39 lie in the axial direction of the permanent magnet arrangement 27, i. e. in the direction of the piston's longitudinal axis 5 preferably laterally adjacent to each other.

Figure 4:
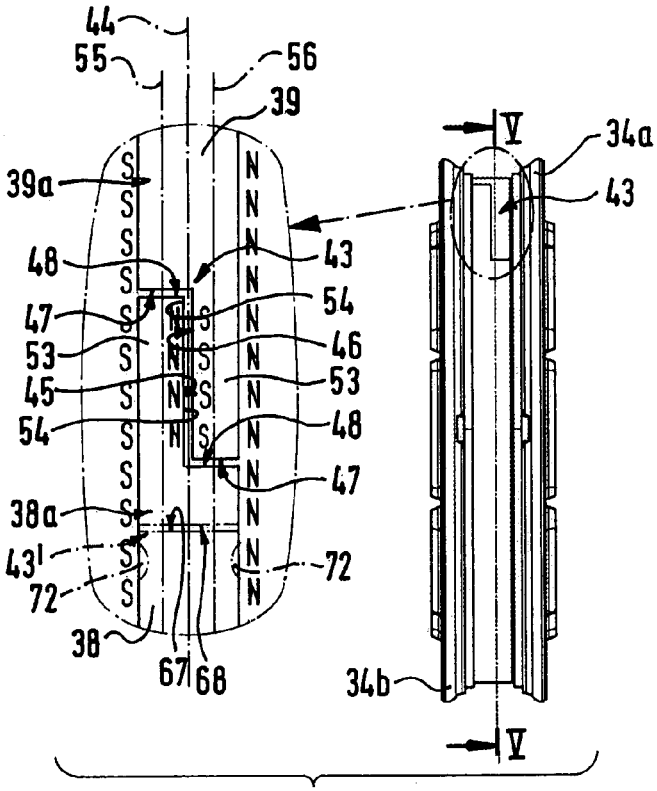
FIG. 4 is a non-sectioned side view of the piston according to FIGS. 1 through 3 without showing the guide ring and with the transition area between two peripheral succeeding magnet segments on a larger scale.

Owing to such overlapping as shown in FIG. 4 in a clear enlarged part there is in the respective overlap zone such a configuration that the mutually associated end sections 38*a*, 39*a* and, respectively, 38*b* and 39*b* inter alia on the one hand are mutually adjacent at limit faces 45 and 46 extending in a first radial plane 44 and on the other hand end face sections 47 and 48, orientated in the peripheral direction 37 are opposite to one another. There is here admittedly adjacent to opposite end faces 47 and 48 magnetic repulsion in the peripheral direction 37, but it is substantially less than the magnetic holding force at the mutually facing axial limit faces 45 and 46. Owing to having a correspondingly large overlap the level of the attractive force may be furthermore readily influenced and so designed that the mutually facing end sections 38*a*, 39*a*, 38*b* and 39*b* may be held together firmly by a self-holding effect owing to the magnetic forces obtaining in the transition zone. The annular configuration accordingly holds together simply owing to magnetic forces acting between the individual magnet segments 38 and 39 so that specific attachment measures are unnecessary in order to secure the magnet segments 38 and 39 in the annular groove 23. If required such attachment measures may nevertheless be provided in addition. The simplest measure to be adopted would be for example a mutual bonding together of the magnet segments 38 and 39 in the transition zones 43 and/or attachment by catches on the support body 22.

In the working embodiment the magnet segments 38 and 39 at the overlapping end sections 38*a*, 39*a*, 38*b* and 39*b*are provided respectively with a spur 53 projecting in the peripheral direction 37 in relation to the reference point 52 and with a recess 54 receding in relation to a reference point 52. The recess 53 is complementary to the spur 53 in design. The spur 53 and the recess 54 of a respective end section 38*a*, 39*a*, 38*b* and 39*b* extend in two mutually axially spaced radial planes 55 and 56 so that in the united state of the magnet segments 38 and 39 at the individual transition zone 43 the spur 53 of the one respective fits into the recess 54 of the respectively other end section in the peripheral direction 37.

At the individual end sections of the magnet segments 38 and 39 the recess 54 is preferably open at the axial side opposite to the adjacent spur 53. Moreover the radially extending side face 57, of a respective recess 54 preferably directly adjoins, in one and the same radial plane, the identically orientated axial side face 58 of the adjacent spur 53. The overlapping face, extending in a radial plane, of two end sections 38*a*, 39*a*, 38*b* and 39*b* accordingly is equal to the sum of the two above mentioned side faces 57 and 58 and is accordingly relatively large.

The side faces 57 and 58 preferably extend in the first radial plane 44 extending through the middle of the width of the permanent magnet arrangement 27. Accordingly there are identical width dimensions of the spurs 53 and of the recesses 54. Thus there is a symmetrical arrangement which renders possible alignment-dependent fitting together of the magnet segments 38 and 39.

It is convenient to provide an axially symmetrically reversed arrangement of the spur 53 and of the recess 54 at the two end sections 38*a*, 39*a*, 38*b* and 39*b* within a respective magnet segment 38 and 39. This will improve stability in the plugged together state.

All in all it is an advantage in the case of all embodiments for the permanent magnet arrangement 27 to be composed of mutually identical magnet segments 38 and 39.

In order despite the spurs 53 extending in the peripheral direction 37 to render possible an overlap in the transition zone 43 even in the case of only two magnet segments 38 and 39 without impairing assembly, the spurs 53 are preferably set at a radial distance "a" from the extended inner peripheral face of the respective magnet segment 38 and, respectively, 39. This radial distance "a" is responsible, in the case of only two magnet segments 38 and 39, which only have to surround one respective half of the piston's periphery, for the width "W" of the assembly opening 63 defined between the two end sections 38*a*, 39*a*, 38*b* and 39*b* of a respective magnet segment 38 and 39 being larger than the diameter of the annular groove 23 at the groove's floor 26. Accordingly the magnet segments 38 and 39, with the assembly opening 63 to the fore, may even be introduced into the annular groove 23 when their arcuate length is respectively greater than 180 degrees owing to the spurs provided for overlap.

At the reference points 52 each magnet segment 38 and 39 preferably has a terminal face 64, orientated in the peripheral direction 37, which starting at the inner peripheral face 62 extends as far as the base zone of the spur 53 radially outward. The magnet segments 38 and 39 mutually combined by being assembled have their terminal faces 64 opposite to each other in pairs and may abut each other.

Figure 5:
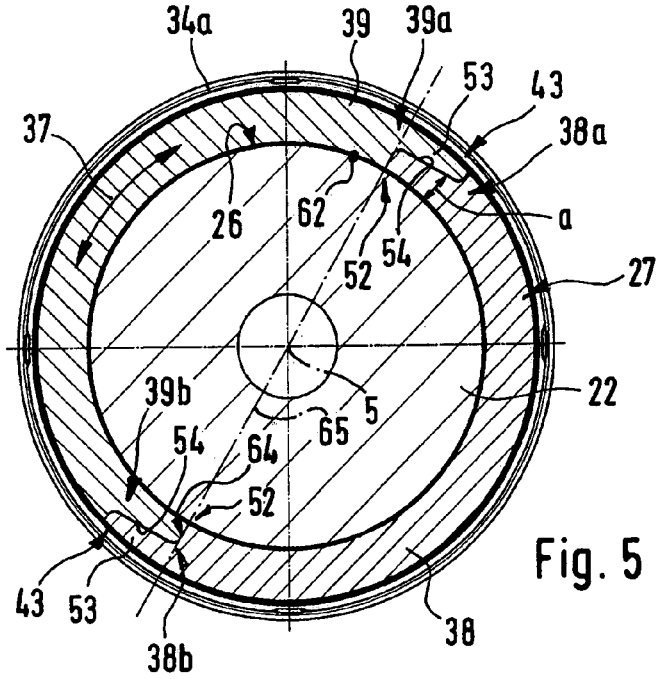
FIG. 5 is a radial section taken through the piston in keeping with FIG. 4 in a plane V-V which is radial in relation to the longitudinal axis of the piston.

In the case of a permanent magnet arrangement 27 comprising only two magnet segments 38 and 39 the two reference points 52 of a respective magnet segment 38 and 39 are preferably on a straight line 65 marked in FIG. 5 in chained lines and intersecting with the longitudinal axis 5 of the piston.

The magnet segments 38 and 39 may also be so designed that in an overlap-free manner they are complementary to each other in the peripheral direction 37. The transition zone between two adjacent end sections may then be designed more particularly in the manner indicated in FIG. 4 at 43" in chained lines, the directly following magnet segments being exclusively facing each other at the end facing s 67 and 68 lying in the same plane, that is to say without an offset in the peripheral direction 37.

Owing to the repulsion forces here normally occurring between the magnet segments 38 and 39 however the fitted together magnet segments 38 and 39 should be additionally secured together. This is performed preferably, as already mentioned, by mutual bonding of the magnet segments 38 and 39 in the transition zones 43' and/or by using attachment means, which is stationary in relation to the support body 22, such attachment means holding the magnet segments 38 and 39 in the annular groove 23. For instance, it is possible to provide projections 72 distributed along and extending into the groove opening 24, such projections 72 straddling the outer periphery of the inserted magnet segments 38 and 39 for some distance and accordingly performing and interlocking function. The projections 72 may in this case be designed as catches or detents so that it is possible to insert the magnet segments 38 and 39 into the annular groove 23 with a detent action and to secure it place. In the case of all working embodiments the magnetization of the magnet segments 38 and 39 in the desired direction may take place either even prior to or only after insertion in the annular groove 23.

What is claimed is:

1. A piston for a fluid operated setting device comprising:

a support body, which possesses an annular recess whose axis coincides with the longitudinal axis of the piston, in which recess at least one annular permanent magnet arrangement is disposed, wherein the permanent magnet arrangement is segmented in its peripheral direction and includes at least two arcuate magnet segments and that the annular recess is in the form of an annular groove with a radially outwardly directed groove opening, into which the magnet segments are inserted radially from the outside with the formation of an annular configuration; and wherein the magnet segments are so formed and so magnetized that the mutually facing end sections of two sequentially following magnet segments are held together simply by magnetic force.

2. The piston as set forth in claim 1, characterized in that the magnet segments all have the same orientation of their magnetization.

3. The piston as set forth in claim 1, characterized in that the magnet segments are magnetized in the axial direction.

4. The piston as set forth in claim 1, characterized in that the permanent magnet arrangement is composed of just two magnet segments with the same accurate length.

5. The piston as set forth in claim 1, characterized in that the mutually facing end sections of at least two adjacent magnet segments are opposite to each other free of overlap in the peripheral direction of the permanent magnet arrangement.

6. The piston as set forth in claim 1, characterized in that the mutually facing end sections of at least two adjacent magnet segments have end faces opposite to each other free of offset in the peripheral direction of the permanent magnet arrangement.

7. The piston as set forth in claim 1, characterized in that at least two adjacent magnet segments overlap at their mutually facing end sections in the peripheral direction of the permanent magnet arrangement.

8. The piston as set forth in claim 7, characterized in that the mutually overlapping zones of the end sections are laterally adjacent to each other in the axial direction of the permanent magnet arrangement.

9. The piston as set forth in claim 7, characterized in that the magnet segments at the mutually facing end sections respectively have a spur projecting in a first radial plane in the peripheral direction of the permanent magnet arrangement in relation to a reference point and a recess receding in a second radial plane in the peripheral direction in relation to the reference point so that the spur of the respective one end section fits into the recess of the respectively other end section when said end sections are overlapping.

10. The piston as set forth in claim 9, characterized in that each magnet segment in the region of the reference point has a terminal face orientated in the peripheral direction of the permanent magnet arrangement and extending radially outwardly from the inner peripheral face of the magnet segment, such terminal face being adjoined by the recess and the spur, the terminal faces of magnet segments combined together being opposite to each other in pairs.

11. The piston as set forth in claim 9, characterized in that in the case of a permanent magnet arrangement including only two magnet segments the reference points assigned to the two end sections of a respective magnet segment lie on a straight line intersecting the longitudinal axis of the piston.

12. The piston as set forth in claim 9, characterized in that the spur and the recess are arranged at a radial distance from the extended inner peripheral face of the associated magnet segment.

13. The piston as set forth in claim 1, characterized in that sequentially following magnet segments are bonded together at the mutually facing end sections.

14. The piston as set forth in claim 1, characterized in that the permanent magnet arrangement is composed of mutually identical magnet segments.

15. The piston as set forth in claim 1, characterized in that the support body is integral at least in the zone thereof defining the annular groove.

16. The piston as set forth in claim 1, characterized in that the permanent magnet arrangement is coaxially surrounded by a guide ring.

17. The piston as set forth in claim 1, characterized in that axially on either side of the annular groove the support body bears a piston seal whose axis coincides with the longitudinal axis of the piston.

18. The piston as set forth in claim 1, characterized by a circular outline.

19. The piston as set forth in claim 1, characterized in that the individual magnet segments are in the form of a circular arc.

20. A fluid power setting device comprising a housing fitted with position detecting means, such housing defining an receiving chamber in which a piston as defined in claim 1 is arranged in a linearly slideable manner, such piston being kinematically coupled with a force output part rendering possible force output outside of the housing.

21. A piston for a fluid operated setting device comprising:

a support body, which possesses an annular recess whose axis coincides with the longitudinal axis of the piston, in which recess at least one annular permanent magnet arrangement is disposed, wherein the permanent magnet arrangement is segmented in its peripheral direction and includes at least two arcuate magnet segments and that the annular recess is in the form of an annular groove with a radially outwardly directed groove opening, into which the magnet segments are inserted radially from the outside with the formation of an annular configuration, and wherein at least two adjacent magnet segments overlap at their mutually facing end sections in the peripheral direction of the permanent magnet arrangement, and the mutually overlapping zones of the end sections are laterally adjacent to each other in the axial direction of the permanent magnet arrangement.

22. A piston for a fluid operated setting device comprising:

a support body, which possesses an annular recess whose axis coincides with the longitudinal axis of the piston, in which recess at least one annular permanent magnet arrangement is disposed, wherein the permanent magnet arrangement is segmented in its peripheral direction and includes at least two arcuate magnet segments and that the annular recess is in the form of an annular groove with a radially outwardly directed groove opening, into which the magnet segments are inserted radially from the outside with the formation of an annular configuration, and wherein at least two adjacent magnet segments overlap at their mutually facing end sections in the peripheral direction of the permanent magnet arrangement, and the magnet segments at the mutually facing end sections respectively have a spur projecting in a first radial plane in the peripheral direction of the permanent magnet arrangement in relation to a reference point and a recess receding in a second radial plane in the peripheral direction in relation to the reference point so that the spur of the respective one end section fits into the recess of the respectively other end section when said end sections are overlapping.

* * * * *